United States Patent [19]

Walker

[11] Patent Number: 4,886,275

[45] Date of Patent: Dec. 12, 1989

[54] GOLF BALL

[76] Inventor: Grant W. Walker, 4339 Lantzy Ct., Sacramento, Calif. 95825

[21] Appl. No.: 284,722

[22] Filed: Dec. 15, 1988

[51] Int. Cl.[4] ..... A63B 69/36

[52] U.S. Cl. ..... 273/183 C; 273/186 D; 273/418

[58] Field of Search ..... 273/183, 186 D, 418, 273/58 A, 29 A, 213

[56] References Cited

U.S. PATENT DOCUMENTS 1,575,281 5/1926 Rosenberg .
1,580,230 7/1926 Brerton .
3,081,091 12/1963 Grow ..... 273/186
4,065,126 2/1977 Mantz ..... 273/58
4,596,392 4/1986 Walker ..... 273/183
4,637,616 10/1987 Whiting ..... 273/418

*Primary Examiner*—George J. Marlo
*Attorney, Agent, or Firm*—Joseph E. Gerber

[57] ABSTRACT

A moderately resilient, energy-absorbing practice golf ball is disclosed having a dense metal-containing core surrounded with a thick layer of resilient material. To this, a fabric cover able to carry a marking powder is bound. This practice ball leaves powder marks at its points of impact, and has a substantially reduced velocity upon rebound.

18 Claims, 1 Drawing Sheet

GOLF BALL

BACKGROUND OF THE INVENTION

1. Field of the invention

The present invention relates generally to practice balls for golf, and more specifically to a moderately resilient, energy-absorbing ball for use in practice areas of limited space.

2. Description of the Related Art

One desiring to become proficient at the game of golf soon learns that excellence is achieved only through diligent practice. Owing to weather and other limitations, it is often desirable to conduct a practice session in an enclosed or limited area, perhaps indoors. Such practice is made much safer when a ball having an energy-absorbing nature is used. Energy-absorbing practice balls have a greatly reduced velocity upon rebound from a rigid target; this avoids damage to nearby objects, and injury to the practicing golfer.

Energy-absorbing practice balls previously disclosed and patented include that shown in U.S. Pat. No. 1,575,281 issued to Rosenberg in 1926 for a practice ball with a seamless knit cover enclosing a fibrous core and the method of constructing same. In the same year, U.S. Pat. No. 1,580,,230 issued to Brerton for a lightweight, indoor practice ball having a surface of yarn ends, or alternatively nappy, roughened cloth.

A later-developed device incorporating marking media for analysis of one's swing is found in U.S. Pat. No. 3,081,091 issued to Grow in 1963. Grow discloses a practice ball with a resilient shell around a fibrous core, the shell having an aperture, and the core carrying a marking powder for release on the face of a golf club head upon impact.

A still later disclosure of a tennis practice ball is somewhat similar; said disclosure is made in U.S. Pat. No. 4,065,126 issued to Mantz in 1977. Therein, a practice ball is shown to include a fibrous core, an inner cloth cover and an outer knit cover. The outer knit cover is capable of carrying a marking powder; the powder is dislodged at the balls position of impact with a practice target.

With a similar purpose in mind, the energy-absorbing golf practice ball of my previous U.S. Pat. No. 4,596,392 issued in 1986, also carries marking powder upon a fabric cover. From the telltale mark this ball leaves, one may assess the raw accuracy of a practice golf shot. In addition, its core is clayey in consistency; the ball becomes deformed upon impact and therefore permits some analysis of the attitude of club face contact. Some indication of the ball's direction of rotation in flight is also afforded, this being approximated from the relative positions of flat areas caused by the first impact of the club face and the second impact of the target board. However, precise analysis of spin is difficult with this earlier ball. Further, it requires manual reshaping after each practice shot. Neither this, nor the other practice balls discussed above have all the qualities needed for a superior moderately resilient, energy-absorbing practice ball. Those qualities include the weight and swing-feel of a regulation golf ball, the ability to carry a marking powder, and a resilient character which obviates the need for reshaping and promotes a true bounce off a target board for accurate spin analysis.

SUMMARY OF THE INVENTION

The practice golf ball of the present invention fulfills the aforedescribed needs and provides other benefits as well. In its several embodiments, the inventive practice ball is comprised of a plurality of layers. Essentially, each embodiment has a dense metal-containing core surrounded with a thick layer of resilient material. To this, a fabric cover able to carry a marking powder is bound. The alternative embodiments disclosed herein differ principally in core structure.

The preferred embodiment of the inventive ball has a core of dense metal shot surrounded and contained by a layer of metal foil. Rubber is wrapped therearound, the powder-carrying fabric in turn surrounding said rubber and forming the outer surface of the ball.

A first alternative embodiment has a core comprised of a spherical pellet of rubber surrounded by a layer of dense metal granules carried in a pliable matrix. Outside this core, the ball is essentially the same as the embodiment described above.

A second alternative embodiment simply has a spherical core of dense metal granules carried in a pliable matrix The inventive method of constructing a moderately resilient, energy-absorbing practice golf ball is also disclosed and claimed. The preferred embodiment discussed above is constructed by, first, wrapping dense metal shot in metal foil to form a core. Strips of uncured rubber are then wrapped around the core and built up into a thick layer. Next, the ball is pressed to give it an even, spherical surface. And then a layer of knit fabric is laid over the rubber and pressed into it. Following this, the ball is subjected to conditions of temperature and pressure sufficient to achieve curing of the rubber and fusion of the ball's layers. Once the rubber is cured, the ball has a moderately resilient, energy-absorbing nature.

The first alternative embodiment discussed above is constructed in the same way, except that construction of the core is itself a two step process. First, dense metal granules are mixed with a solvent-based adhesive. Then this mixture is formed into a layer around a spherical pellet of uncured rubber. After the adhesive is sets up, this core is wrapped with a layer of uncured rubber and, in turn, fabric as above. Curing follows.

The process of constructing the second alternative embodiment differs from the process of constructing the first only in that the core is made by forming the same mixture of metal granules and solvent-based adhesive directly into a spherical core pellet, rather than wrapping it around an uncured rubber core. Around this the uncured rubber, and then the fabric layer, are wrapped before the ball is cured.

Abrasion of the outer surface of all embodiments of the ball helps expose and raise the fibers of the knit fabric layer, thereby creating a nappier surface suitable for carrying marking powder.

Thus, an inventive golf practice ball is disclosed, an object of which is to absorb the energy of a full power golf swing thereby resulting in a low speed, moderate energy rebound off a target board.

It is another object of the present invention to provide a moderately resilient, energy-absorbing practice golf ball able to carry marking powder and deposit it on a club face and a target board during a practice shot.

It is a further object of the present invention to provide an energy-absorbing practice golf ball with sufficient resilience to return said ball to its spherical shape immediately following an impact with a golf club head or a target board.

Still a further object of the present invention is to provide a golf practice ball durable enough to withstand repeated high impact use.

Another object of the present invention is to provide a practice golf ball having a powder-carrying surface and the tendency to transfer its spin into angular deflection upon contact with a smooth surfaced target.

It is also an object of the present invention to provide a golf practice ball with a weight and swing-feel very similar to that of a regulation golf ball.

And, it is equally an object of the present invention to provide a process whereby a practice golf ball having the foregoing beneficial characteristics may be constructed.

Still further objects of the inventive practice golf ball will be apparent from the drawings and following detailed description thereof.

DESCRIPTION OF THE PREFERRED EMBODIMENT

The combination of elements included in the inventive practice golf ball, as well as the process of constructing it in its several embodiments, are claimed.

Figure 1:
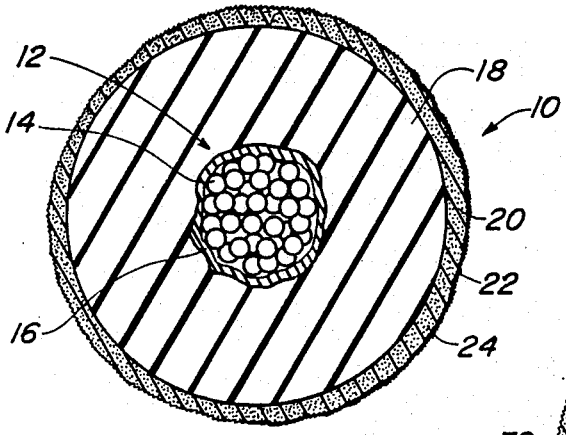
FIG. 1 is a view of the preferred embodiment of the inventive practice golf ball in diametrical section.

Elements of Practice Golf Ball:

Referring now specifically to the drawings, FIG. 1 shows the preferred embodiment of the inventive practice golf ball generally referred to by reference numeral 10. Alternative embodiments of the inventive practice ball will also be disclosed, but all include a dense, metal-containing core surrounded with a thick layer of resilient material. To this, a textile fabric cover able to carry a marking powder is bound. The embodiments disclosed differ principally in their core structures.

The preferred embodiment of practice ball 10 is comprised of four layers. At the center of the ball is a core 12 comprised of a plurality of spherical, dense metal pellets 14 surrounded and contained by at least one layer of metal foil 16. Lead shot wrapped in lead foil has been found to work well, but other combinations such as steel or iron shot in aluminum foil may also give satisfactory results. Shot of size no. 12 is optimum, whatever the metal. No adhesive matrix is necessary in this core; metal foil 16 binds pellets together sufficiently well.

Core 12 is surrounded by a thick layer of resilient material 18, the layer's dimension being dictated by the intended size of the ball and the amount of material, in relation to the makeup of the core, necessary to give the ball its desired characteristics.

One moderately resilient material used with success is a "low-energy," butyl rubber having, in its cured state, a durometer reading of about 63, a tensile strength of about 1,500 pounds per square inch and an elongation of about 500 per cent. This rubber is designated as "low-energy" for its tendency to spring slowly back to its original shape after impact, but not so slowly as to cause it to be obviously misshapen for any period of time. When incorporated into a practice ball, this character assists in reducing the velocity of a practice ball after it strikes a rigid target.

The exact composition and method of production of this low-energy rubber remain a trade secret of Cal-Neva Supply of Oakland, Calif. However, the product is freely available from that source in an uncured state, and may be cured according to the directions disclosed below to yield a resilient material with the qualities desired. This type of rubber, when bound to a dense core, is found to absorb a sufficient amount of energy from a full power swing to give the ball its intended moderately resilient character. Alternative rubber compositions and other natural or synthetic materials may be substituted for this as long as they cooperate with the other elements of the invention to yield a moderately resilient, energy-absorbing practice ball.

By way of definition, the term "moderately resilient" when used to describe the inventive practice ball 10 will be understood here and in the claims to mean resilient enough to return quickly to its former shape upon impact, but not so resilient and quickly reforming as to cause the velocity of such a ball to be conserved in its rebound. And "energy-absorbing" will be understood to describe the tendency of the initial velocity of such a moderately resilient ball to be transferred into deformation of the ball rather than rebound velocity.

The final, outer layer is a textile fabric cover 20 bound to resilient layer 18. Said fabric is preferably polyester and of double knit construction having a somewhat stretchy character. This fabric also preferably has interstices in its surface which facilitate carrying marking powder. As more fully described below, said fabric cover 20 is pressed into the surface of rubber layer 18 and bound thereto when the rubber is cured.

Upstanding from fabric cover 20 is a nap of raised fibers 22. Fibers 22 aid in carrying particles of marking powder 24 which, upon impact, are dislodged upon the golf club head 28 and target board 30 shown in FIG. 2. Said particles are preferably of talcum powder, or the like.

Figure 3:
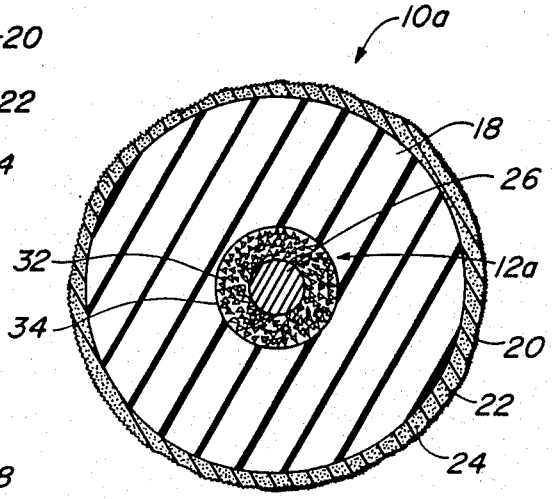
FIG. 3 is a diametrical section of a first alternative embodiment of the inventive practice ball having a core of resilient material surrounded with metal particles in a pliable matrix.

A first alternative embodiment of the inventive practice ball is generally referred to by reference numeral **10*a* and shown in FIG. 3. Ball 10*a* has a differently constructed core which is referred to by reference numeral 12*a*. Therein, a spherical pellet of resilient material 26 is wrapped in a layer of dense metal granules 32 bound in a pliable matrix 34. The resilient material is conveniently the type of low-energy rubber described above. Metal granules 32 are preferably lead, but other dense metals may also work well. Pliable matrix 34** is preferably an adhesive, contact cement being one adhesive used with success.

Outside this alternative core **12*a*, ball 10*a*** is essentially the same as the preferred embodiment described above.

Figure 4:
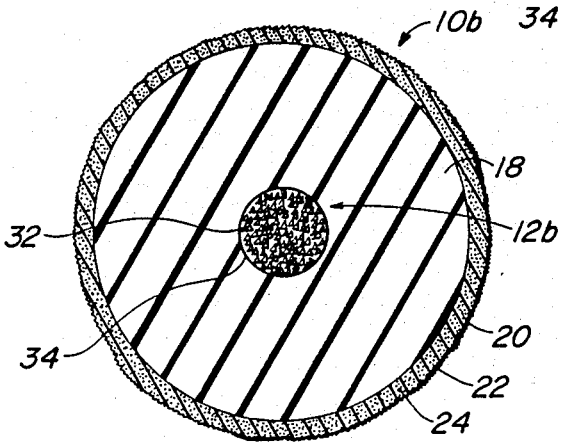
FIG. 4 is a diametrical section of a second alternative embodiment of the inventive practice ball having a core of metal particles in a pliable matrix.

A second alternative embodiment of the inventive practice ball is shown in FIG. 4, and is generally referred to by reference numeral **10*b*. Ball 10*b* essentially lacks the resilient, spherical core pellet 26 of first alternative ball 10***a*. Its core 12*b* is, instead, a sphere of the same dense metal particles 32 suspended in a pliable matrix 34 as surround resilient pellet 26 of ball 10*a*.

The rest of ball 10*b* is the same as the other embodiments; it has a thick resilient layer around the core and a nappy fabric cover.

Variables such as the size and density of the core and the thickness of the resilient layer may be adjusted to yield a practice ball that absorbs, by deformation, most of the energy of a full power practice swing. The only constraints imposed are the weight and size of a regulation golf ball. The practice ball should conform closely to the 45 gram weight of a regulation golf ball. But, it may be somewhat smaller in size if desired, this not being as critical a factor, although it should be no larger. When the combination of elements is properly adjusted, the ball should rebound from target 30 at a substantially decreased velocity, rather than conserving its initial velocity. The energy-absorbing quality of the layer of resilient material, in combination with the dense core, produce this effect.

Process Of Constructing Practice Golf Ball:

The processes of constructing the alternative embodiments of the inventive practice ball are also claimed. Since only the cores differ in the several alternative embodiments, said processes differ only with respect to the said cores.

Practice ball 10 of FIG. 1 is constructed by, first, wrapping a plurality of dense metal pellets 14 in metal foil 16 to form a core. Next, strips of uncured rubber are wrapped around this core and built up into a thick layer. Once a sufficient amount of rubber has been laid over the core to form a rough ball, it is then pressed into a uniform sphere. A single layer of fabric 20 is, in turn, pressed into the surface of said uncured rubber, said rubber thereafter tending to hold said fabric in place. Following this, a curing process is commenced whereby the ball is subjected to increased temperature and pressure for a sufficient time to cure said uncured rubber, fuse the ball's layers together, and, upon cooling, yield a practice ball with the desired qualities.

Conditions comprising a pressure of approximately 5000 pounds per square inch and a temperature of approximately 325 degrees Fahrenheit maintained for one and one half hours have been found to be optimum for curing the preferred uncured rubber identified above. However, different conditions may be acceptable for different rubber compositions and alternative resilient materials.

Finally, the fabric surface of the ball is abraded to raise a nap of fibers for assisting the interstices of the fabric in the retention of marking powder. Placing the ball in a sandpaper-lined, rotating drum has been found to work well to raise the desired nap.

The process of constructing alternative practice ball 10*a* of FIG., 3 first requires mixing a quantity of dense metal granules 32 with a solvent-based adhesive. As noted above, common contact cement has been found to be a satisfactory adhesive for this purpose. Upon addition of granules 16 to the contact cement, a gritty paste is formed which is best spread out into a thin sheet to set up. Then, an even layer of this pliable mixture is wrapped around a spherical pellet of the uncured rubber identified above, thus forming a two-layered core. The remainder of steps in the process of constructing alternative practice ball 10*a*, from the core outward, are the same as were recited above for construction of ball 10 of FIG. 1; i.e., the core is wrapped in a layer uncured rubber, the rubber is covered with fabric, and curing and abrading follow.

The process of constructing alternative ball 10*b* of FIG. 4, again, differs only in the construction of the core. Herein, the same mixture of dense metal granules and contact cement used in alternative ball 10*a* is employed. A quantity of said mixture is first spread out and allowed to set up. A wad of the pliable mixture is then rolled into a spherical pellet to form the core of ball 10*b*. Over this, as before, the uncured rubber and fabric are laid. And, the ball is finally cured with pressure and temperature, and abraded.

Use Of Inventive Practice Ball

Figure 2:
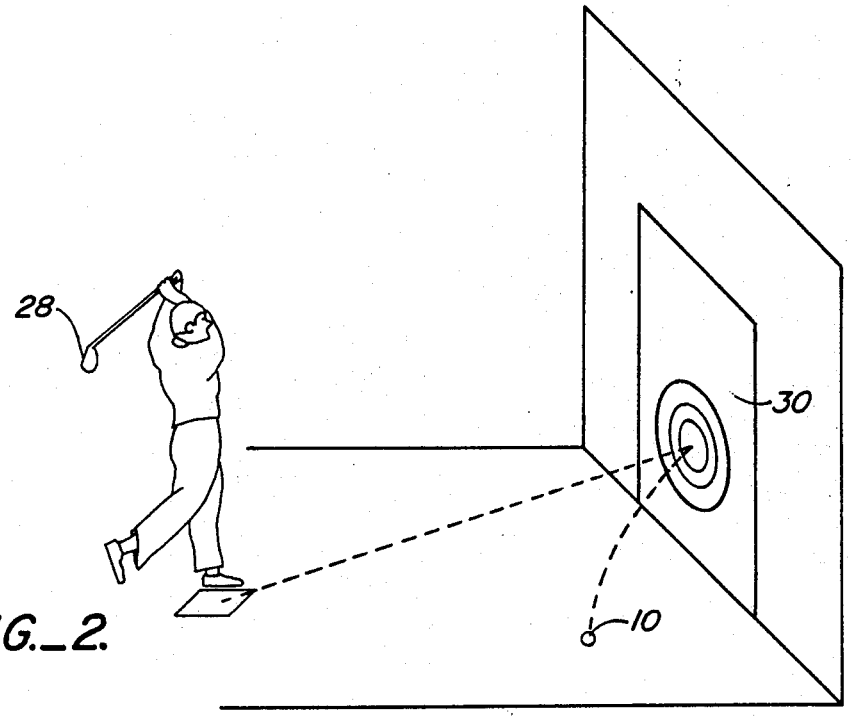
FIG. 2 is a perspective of a practicing golfer driving the inventive practice ball of FIG. 1 against a rigid target.

In use, the inventive practice golf ball is dipped in talcum powder, or the like, and then placed on the surface from which a golfer desires to execute a practice shot. As shown in FIG. 2, the practice ball is best driven against an upright, rigid target 30. The golfer addresses the ball in the usual fashion and drives it against the target.

Once the practice shot is complete, the golfer may inspect the marking powder left at the points of impact and thereby analyze several aspects of the shot. For example, inspection of the golf club head 28 will reveal how squarely the ball was hit. An off-center powder mark may indicate the tendency to "hook," "slice" or "top" the ball. Next, the powder mark on the target may be inspected to assess the raw accuracy of the shot. And finally, the mark left by the ball after its rebound from the target will indicate the character of any spin that was put on the ball. For example, if the rebound mark is to the right of the mark on the target, as in FIG. 2, this indicates that right spin was put on the ball which corresponds to a tendency to hook in actual play. Similarly, left spin would be indicated by a powder mark to the left, corresponding to a slice.

The moderately resilient character of the inventive practice ball, in all its embodiments, gives it the ability to reestablish its shape quickly after impact, thereby minimizing the possibility that the disfigured shape of the ball will interfere with its true flight path or rebound direction. Said moderate resilience, along with the ball's energy-absorbing character, also assure that the initial velocity of the ball is greatly reduced after its impact with the target, thereby providing for safer practice in confined spaces.

The foregoing detailed disclosure of the inventive practice golf ball, and the process of producing it, are considered as only illustrative of the preferred embodiment and description of, and not a limitation upon the scope of, the invention. Those skilled in the art will envision many other possible variations of the structures and processes disclosed herein that nevertheless fall within the scope of the following claims. For example, adjustment of the size of the core and its concentration of dense metal, as well as the thickness, composition and density of the resilient material wrapped around it, may beneficially alter the characteristics of the ball while remaining within the size and weight parameters of a regulation ball. And, alternative uses for this practice ball may later be realized. Accordingly, the scope of the invention should be determined with reference to the appended claims, and not by the examples which have herein been given.

What is claimed is:

1. A moderately resilient, energy-absorbing practice golf ball comprising:

a. a dense metal-containing core;

b. a thick layer of resilient material bound around said core, said thick layer having a substantially spherical outer surface; and, c. a textile fabric cover bound to said surface of said resilient material for carrying marking powder.

2. The practice golf ball of claim 1, wherein said ball is substantially the same weight as a regulation golf ball.

3. The practice golf ball of claim 1, wherein said ball is no larger than a regulation golf ball.

4. The practice golf ball of claim 1, wherein said core comprises a plurality of substantially spherical, dense metal pellets.

5. The practice golf ball of claim 4, wherein said pellets are lead metal pellets.

6. The practice golf ball of claim 4, wherein said pellets are surrounded by at least one layer of metal foil.

7. The practice golf ball of claim 6, wherein said foil is lead metal foil.

8. The practice golf ball of claim 1, wherein said core includes a plurality of dense metal granules.

9. The practice golf ball of claim 8, wherein said granules are lead metal granules.

10. The practice golf ball of claim 8, wherein said granules are suspended in a pliable matrix.

11. The practice golf ball of claim 10, wherein said matrix is contact cement.

12. The practice golf ball of claim 10, wherein said granules suspended in a pliable matrix are bound in a layer around a central core comprising a substantially spherical pellet of resilient material.

13. The practice golf ball of claim 12, wherein said resilient pellet is rubber.

14. The practice golf ball of claim 13, wherein said rubber is low-energy rubber.

15. The practice golf ball of claim 1, wherein said layer of resilient material is rubber.

16. The practice golf ball of claim 15, wherein said rubber is low-energy rubber.

17. The practice golf ball of claim 1, wherein said fabric is bound into the surface of said thick layer of resilient material.

18. The practice golf ball of claim 1, wherein said fabric cover has a raised nap of fibers.

* * * * *